US008672180B2

(12) United States Patent
Renjilian

(10) Patent No.: US 8,672,180 B2
(45) Date of Patent: Mar. 18, 2014

(54) DISPENSING BIN FOR MULTIPLE MATERIALS

(75) Inventor: Jason Renjilian, Newtown, CT (US)

(73) Assignee: Sealed Air Corporation, Elmwood Park, NJ (US)

( * ) Notice: Subject to any disclaimer, the term of this patent is extended or adjusted under 35 U.S.C. 154(b) by 315 days.

(21) Appl. No.: 13/194,625

(22) Filed: Jul. 29, 2011

(65) Prior Publication Data

US 2013/0026173 A1 Jan. 31, 2013

(51) Int. Cl.
*B65G 3/00* (2006.01)

(52) U.S. Cl.
USPC ..... 221/92; 221/174

(58) Field of Classification Search
USPC ..... 221/1, 92, 174
See application file for complete search history.

(56) References Cited

U.S. PATENT DOCUMENTS

| | | | | |
|---|---|---|---|---|
| 6,428,246 | B1 | 8/2002 | Landrum | |
| 6,519,916 | B1 | 2/2003 | Brown | |
| 6,910,610 | B2 | 6/2005 | Barlett et al. | |
| 6,996,955 | B2 | 2/2006 | White, Jr. et al. | |
| 7,273,142 | B2 | 9/2007 | Huis et al. | |
| 7,318,459 | B2 | 1/2008 | Frankeberger et al. | |
| 7,534,074 | B2 | 5/2009 | Kato | |
| 7,823,367 | B2 | 11/2010 | Boigues et al. | |
| 7,914,239 | B2 | 3/2011 | Van Huis | |
| 8,261,939 | B2 * | 9/2012 | Knoth | 221/103 |
| 2003/0079439 | A1 | 5/2003 | Brown | |
| 2006/0042190 | A1 | 3/2006 | Garceau et al. | |
| 2007/0020162 | A1 * | 1/2007 | Scudder et al. | 422/307 |
| 2008/0128423 | A1 * | 6/2008 | Rick et al. | 220/500 |
| 2008/0148955 | A1 * | 6/2008 | Neace et al. | 99/279 |
| 2008/0164253 | A1 * | 7/2008 | Truong | 220/4.27 |
| 2008/0283551 | A1 * | 11/2008 | Hoff et al. | 222/1 |
| 2012/0209420 | A1 * | 8/2012 | Christy et al. | 700/218 |
| 2013/0161211 | A1 * | 6/2013 | Oren | 206/221 |
| 2013/0161354 | A1 * | 6/2013 | Oren | 222/185.1 |
| 2013/0226337 | A1 * | 8/2013 | Leech et al. | 700/235 |
| 2013/0233878 | A1 * | 9/2013 | Lindmayer | 222/1 |
| 2013/0233895 | A1 * | 9/2013 | Landman et al. | 222/399 |

OTHER PUBLICATIONS

Brochure for Jet Stream™ Delivery Solutions, 2008, published by Sealed Air Corporation.

* cited by examiner

*Primary Examiner* — Alexandra Elve
*Assistant Examiner* — Eyamindae Jallow
(74) *Attorney, Agent, or Firm* — Alston & Bird LLP

(57) ABSTRACT

Various embodiments of the present invention are directed to systems for dispensing multiple types of materials, such as packing materials. According to various embodiments, the systems include a dispensing bin with multiple compartments configured to receive and dispense different types of materials, such as air-filled dunnage cushions and air-filled protective material. In certain embodiments, the dispensing bin is configured to receive materials from one or more supply machines and dispense the materials such that more than one type of material is provided to numerous packing stations for use in packaging items.

17 Claims, 7 Drawing Sheets

DISPENSING BIN FOR MULTIPLE MATERIALS

BACKGROUND OF THE INVENTION

1. Field of the Invention

Various embodiments of the present invention described herein generally relate to apparatuses and methods for dispensing multiple materials, and in particular to dispensing different types of packing materials from a single dispensing apparatus.

2. Description of Related Art

Packing materials are commonly used in the packaging industry to protect packaged items as they are being shipped. In particular, many items are packaged with multiple types of packing materials, which work together to protect an item during shipping. For example, before being placed in a shipping container, items are often wrapped or covered with an air-filled protective cushioning material, such as Bubble Wrap® brand protective cushioning. The air-filled protective cushioning serves to protect the packaged item by absorbing impacts that might otherwise be fully transmitted to the packaged item during transit. In addition, items are often packaged with air-filled dunnage cushions, such as Fill-Air® brand cushions. The air-filled dunnage cushions—also referred to as void-fill cushions—serve to fill otherwise open space in the item's shipping container and restrict the movement of the packaged item within the container to further reduce the likelihood of damage to the item. Multiple types of non-air-filled materials, such as foam dunnage or protective materials are also commonly used in packaging items.

Businesses that pack and ship items often have packaging operations including numerous packing stations at which workers pack items with packing materials. The packaging operation may include a number of systems configured to provide a particular type of material (e.g., air-filling an air-filled packing material) and deliver the packing material to an overhead bin positioned at a respective packing station. The bin may be configured to dispense the packing material to workers at the packing station for use in packaging various items.

As an example, U.S. Pat. No. 6,996,955 describes a system for making and delivering air-filled dunnage cushions to multiple packing stations. In particular, the '955 patent suggests providing a cushion supply machine that air-fills and delivers strings of air-filled dunnage cushions via ducting to a plurality of hoppers each positioned above packing stations. Similarly, U.S. Pat. No. 7,273,142 describes a system for delivering packaging cushions to multiple hoppers positioned above packing stations via a conveyor. However, these systems are only configured for supplying and dispensing a single type of air-filled material to their respective packing stations.

Accordingly, there remains a need in the art for an apparatus that can distribute multiple types of materials to numerous packing stations. In addition, there is a particular need for such an apparatus to conserve floor space in a manufacturing environment and to have a low cost of production and installation.

BRIEF SUMMARY OF THE INVENTION

Various embodiments of the present invention are directed to a bin for dispensing first and second materials. According to various embodiments, the bin comprises an inner compartment defining one or more inner compartment receiving apertures providing access for loading the first material into the inner compartment and defining one or more inner compartment dispensing apertures providing access for dispensing the first material from the inner compartment; and an outer compartment providing access for loading the second material into the outer compartment and defining one or more outer compartment dispensing apertures providing access for dispensing the second material from the outer compartment. In various embodiments, at least an elevated portion of the outer compartment is positioned above the inner compartment and at least a surrounding portion of the outer compartment surrounds a lateral portion of the inner compartment. Furthermore, in various embodiments, the bin is configured to receive and dispense the first and second materials without commingling the first and second materials.

In addition, various embodiments of the present invention are directed to method of dispensing first and second materials from the above-described bin. According to various embodiments, the method comprises the steps of: loading the first material into the inner compartment of the bin; loading the second material into the outer compartment of the bin; accessing the first material via one or more of the inner compartment dispensing apertures of the bin and removing the first material from the inner compartment of the bin; and accessing the second material via one or more of the outer compartment dispensing apertures of the bin and removing the second material from the inner compartment of the bin.

In addition, various other embodiments of the present invention are directed to a system for dispensing first and second materials. According to various embodiments, the system comprises a bin comprising an inner compartment defining one or more inner compartment dispensing apertures and an outer compartment defining one or more outer compartment dispensing apertures; a first material supply machine configured for conveying the first material into the inner compartment; and a second material supply machine configured for conveying the second material into the outer compartment. In various embodiments, the inner and outer compartments are configured such that first materials disposed within the inner compartment are directed to the inner compartment dispensing apertures and second materials disposed within the outer compartment are directed to the outer compartment dispensing apertures, the inner and outer compartments preventing commingling of the first and second materials within the bin.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF THE INVENTION

The present inventions will now be described more fully hereinafter with reference to the accompanying drawings, in which some, but not all embodiments of the inventions are shown. Indeed, these inventions may be embodied in many different forms and should not be construed as limited to the embodiments set forth herein. Rather, these embodiments are provided so that this disclosure will satisfy applicable legal requirements. Like numbers refer to like elements throughout.

Various embodiments of the present invention are directed to a dispensing bin configured for dispensing multiple types of materials, as well as systems for conveying materials to such bins as part of an integrated packing operation. According to various embodiments, the dispensing bin generally comprises at least two separate compartments, each compartment being configured for receiving and dispensing packing materials. In certain embodiments, at least one of the bin's compartments is configured for receiving and dispensing a first type of packing material that flows relatively easily throughout an enclosed area (e.g., strings of air-filled dunnage cushions), while at least one other compartment is configured for receiving and dispensing a second type of packing material that is generally more resistive to flow throughout an enclosed area (e.g., sheets of air-filled protective cushioning).

According to certain embodiments, in order to dispense both types of packing materials, the bin's first and second compartments include one or more dispensing apertures positioned such that at least one of the first compartment's dispensing apertures is positioned proximate to at least one of the second compartment's dispensing apertures. By locating pairs of dispensing apertures at different points around the perimeter of the bin, a single bin can be configured to dispense multiple types of packing materials to numerous packing stations. In addition, this configuration permits a single supply machine to provide a particular type of packing material to a plurality of packing stations, thereby reducing the amount of floor space required to produce and dispense the packing material. Various embodiments of the dispensing bin are described below, along with various embodiments of systems for conveying packing materials as part of an integrated packing operation.

Dispensing Bin

Figure 1:
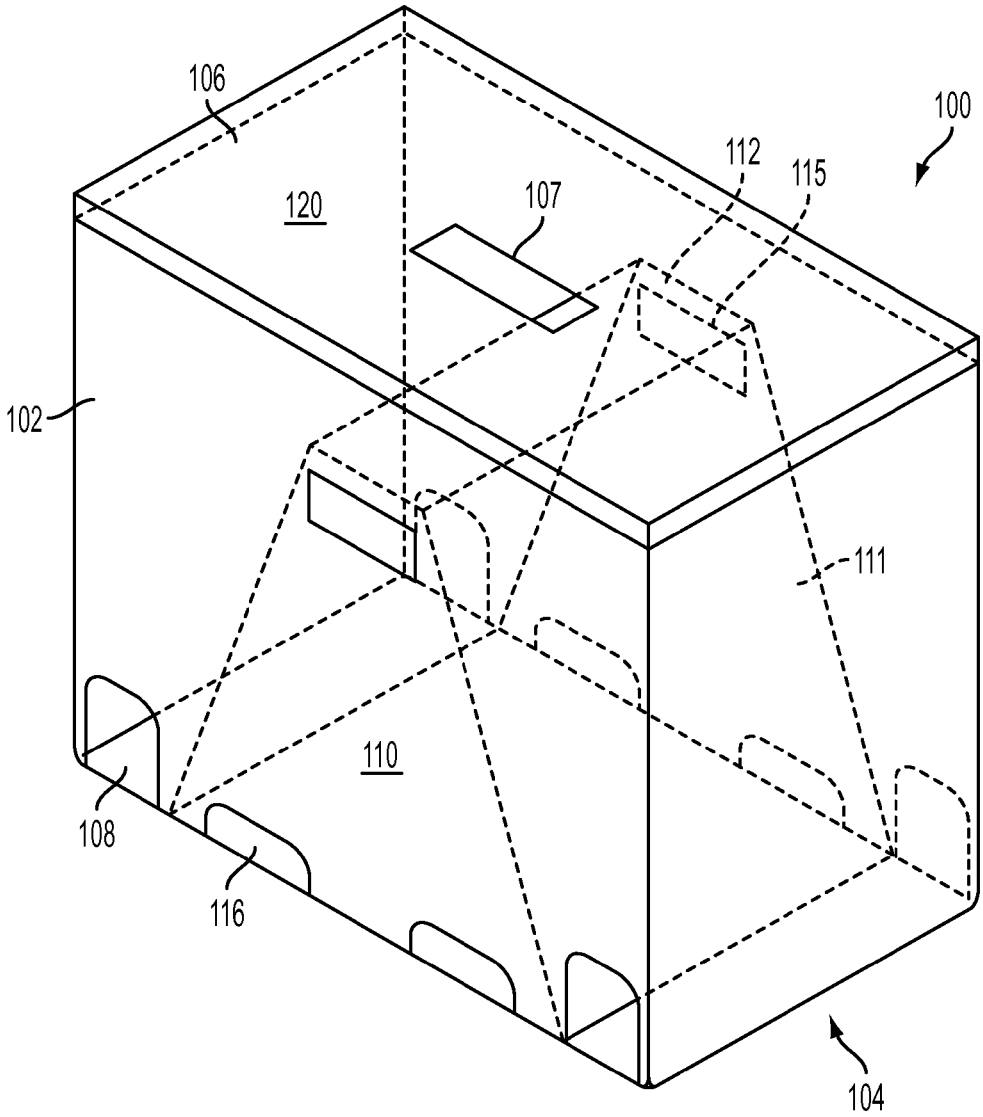
FIG. 1 shows a perspective view of a dispensing bin according to one embodiment of the present invention.

FIG. 1 illustrates a dispensing bin 100 according to one embodiment. As described in detail below, the bin 100 includes two compartments in the form of an inner compartment 110 and outer compartment 120, each of which is configured to receive and dispense different types of materials (e.g., different types of packing materials).

In the illustrated embodiment of FIG. 1, the bin 100 comprises a plurality of outer walls including four sidewalls 102, a bottom wall 104, and a top wall 106. The bin 100 further comprises a plurality of inner walls including two sloped walls 111 and an upper wall 112. As shown in FIG. 1, the lower ends of the sloped walls 111 are affixed to the bin's bottom wall 104 and the upper ends of the sloped walls 111 are affixed to the upper wall 112. In addition, the sides of each of the sloped walls 111 are affixed to two of the bin's sidewalls 102. Likewise, the ends of the upper wall 112 are affixed to the bin's sidewalls 102 proximate to the upper ends of the sloped walls 111. In the illustrated embodiment of FIG. 1, the sloped walls 111 intersect with the bottom wall 104 to form an acute angle with an inner compartment portion of the bottom wall 104 of approximately 45 degrees. However, as will be appreciated from the description herein, the sloped walls 111 may form any wider or narrower acute angles. For example, various embodiments of the bin 100 include sloped walls 111 forming acute angles between 30 and 60 degrees.

The bin's various inner and outer walls define the inner compartment 110 and the outer compartment 120. In particular, the inner compartment 110 is comprised of the volume within the inner walls, while the outer compartment 120 is comprised of the volume between the inner walls and outer walls. As will be appreciated from FIG. 1, the inner compartment 110 has a generally rectangular horizontal cross-section, the area of which decreases toward the upper portions of the inner compartment 110 as a result of the sloped walls 111. Correspondingly, the outer compartment 120 includes an elevated portion that extends above the inner compartment's upper wall 112 and surrounding portions positioned on the sides of the inner compartment's sloped walls 111. As described in greater detail herein, the inner compartment 110 and outer compartment 120 are configured to separately receive, contain, and dispense different types of packing materials.

The bin's outer walls also define a plurality of apertures dimensioned for receiving and dispensing packing materials. In the illustrated embodiment, the bin's sidewalls 102 define an outer compartment receiving aperture 107 and four outer compartment dispensing apertures 108. The outer compartment receiving aperture 107 is defined in a medial portion of the top wall 106 and is dimensioned for receiving the end of a duct or conveyor arm from which packing materials may be dispensed into the outer compartment 120. As shown in FIG. 1, the outer compartment dispensing apertures 108 are positioned proximate each of the bin's four corners, near the edges of the sidewalls 102 and bottom wall 104. As described in greater detail herein, in the illustrated embodiment, the outer compartment dispensing apertures 108 are dimensioned for dispensing strings of air-filled dunnage cushions.

The bin's sidewalls 102 also define two inner compartment receiving apertures 115 and four inner compartment dispensing apertures 116. The inner compartment receiving apertures 115 are positioned just below either end of the inner compartment's upper wall 112 and adjacent the upper ends of the sloped walls 111. Both inner compartment receiving apertures 115 are dimensioned for receiving the end of a duct or conveyor arm from which packing materials may be dispensed into the inner compartment 110. As shown in FIG. 1, the inner compartment dispensing apertures 116 are positioned proximate each of the four outer compartment dispensing apertures 108, adjacent the bottom wall 104 and the lower ends of the angle walls 111. For example, in various embodiments, the inner compartment dispensing apertures 116 are positioned proximate enough to the outer compartment dispensing apertures 108 to enable a human of average size to access packing materials dispensed from a pair of apertures 116, 118. As such, in certain embodiments, the inner compartment dispensing apertures 116 are positioned within six feet of the nearest outer compartment dispensing aperture 108. As described in greater detail herein, in the illustrated embodiment, the inner compartment dispensing apertures 116 are dimensioned for dispensing sheets of air-filled protective cushioning.

As noted above, the bin's compartments 110, 120 are generally configured to receive, contain, and dispense different types of packing material. As such, according to various embodiments, the bin 100 may be constructed from any materials capable of defining the bin's inner and outer walls and maintaining separation of the packing materials disposed in the compartments 110, 120. This configuration prevents commingling of the different packing materials disposed in the compartments 110, 120. For example, in certain embodiments, the bin 100 is constructed from a lightweight, translucent nylon or mesh material. In such embodiments, the material's lightweight permits the bin 100 to be suspended from a variety of fixtures, while the material's translucent properties permit workers in a packaging environment to see within the bin 100 and monitor the packing materials contained therein. In embodiments where the bin 100 is constructed from flexible materials, such as fabric or plastic materials, the bin's walls may be joined together by stitching, rivets, adhesives, bonding, or other joining techniques to form seams between the various inner and outer walls.

System for Dispensing Packing Materials

Figure 2:
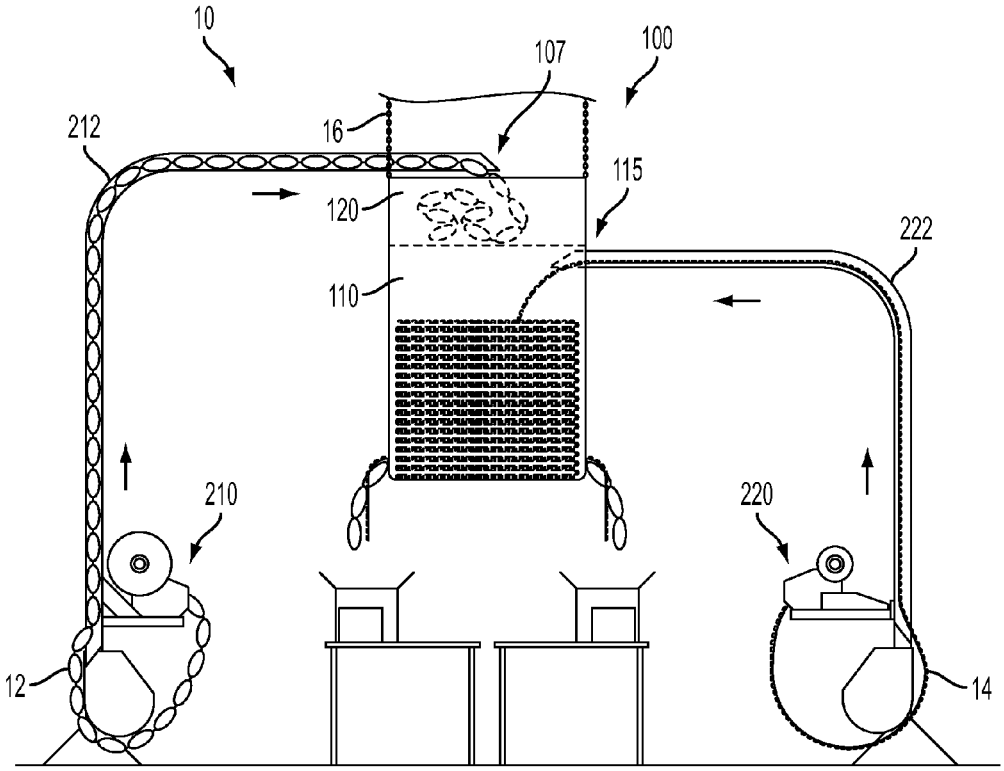
FIG. 2 shows a side plan view of a dispensing system according to one embodiment of the present invention.

FIG. 2 illustrates a system 10 for dispensing multiple packing materials according to one embodiment. In the illustrated embodiment, the system 10 comprises the above-described bin 100, a dunnage material supply machine 210, and a protective material supply machine 220. As shown in FIG. 2, which provides a cut-away side view of the system 10, the bin 100 is suspended above packing stations by chains 16 (e.g., from a ceiling or other fixture) and filled with air-filled packing material by the supply machines 210, 220. As will be appreciated from the description herein, in various other embodiments, the bin 100 may be positioned above the packing stations by various other methods (e.g., mounting the bin on rigid legs or scaffolding resting on a floor surface)

In the illustrated embodiment, the dunnage material supply machine 210 is configured to air-fill and convey strings of dunnage cushions. For example, in one embodiment, the dunnage material supply machine 210 comprises a Fill-Air Cyclone® System (manufactured by Sealed Air Corporation) that is configured to air-fill and convey strings of Fill-Air® brand cushions.

Figure 3:
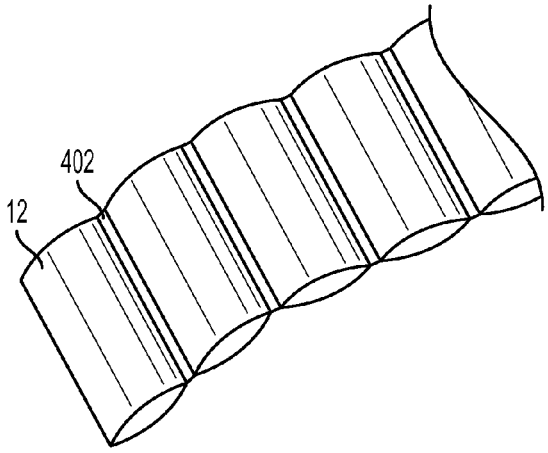
FIG. 3 shows a perspective view of a string of air-filled dunnage cushions according to one embodiment of the present invention.

FIG. 3 illustrates a string of air-filled dunnage cushions 12 generated by the supply machine 210 according to one embodiment. As shown in FIG. 3, the string comprises a plurality of air-filled dunnage cushions 12 separated by gaps 402 of plastic film material. The air-filled dunnage cushions 12, also referred to as void-fill cushions, are generally configured for filling open space in an item's shipping container in order to restrict the movement of the item within the container. Accordingly, in certain embodiments, the gaps 402 between the air-filled dunnage cushions 12 may be perforated to enable workers to easily separate one or more dunnage cushions 12 from the string and place them in a package.

In the illustrated embodiment, the protective material supply machine 220 is configured to generate sheets of air-filled protective cushioning. For example, in one embodiment, the protective material supply machine 220 comprises a NewAir I.B.® Express System (manufactured by Sealed Air Corporation) that is configured to air-fill and covey sheets of Barrier Bubble® or Bubble Wrap® brand protective cushioning.

Figure 4:
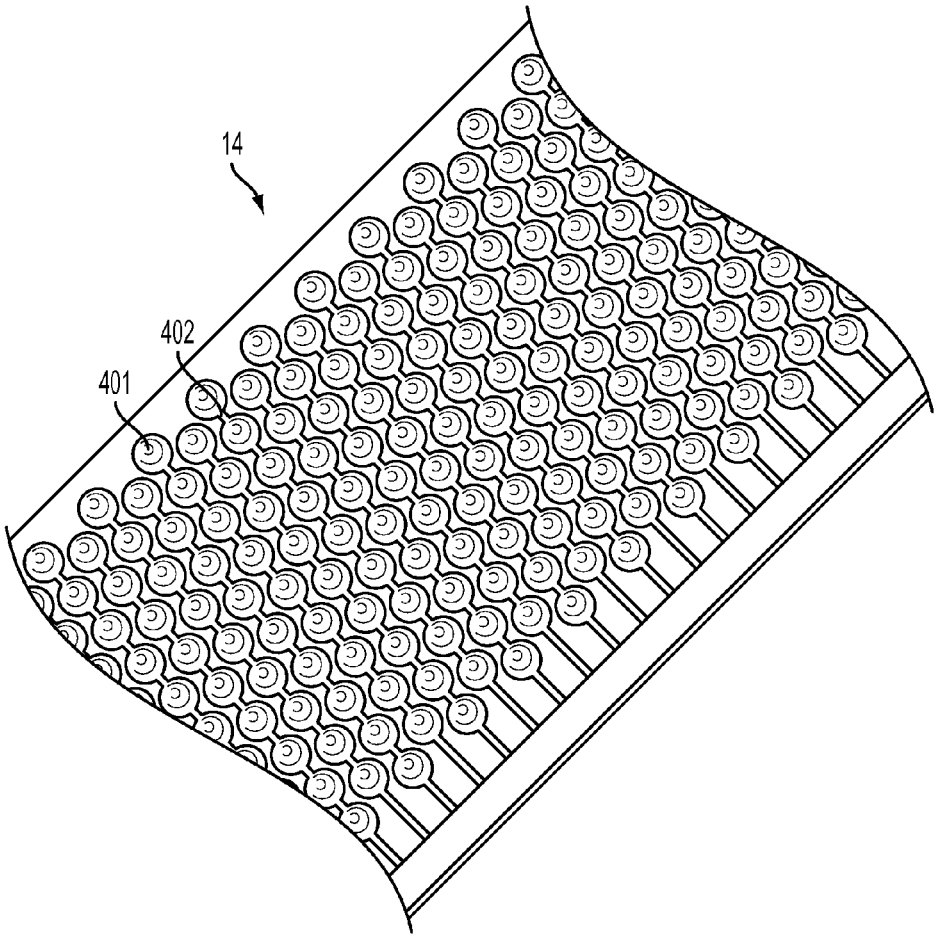
FIG. 4 shows a perspective view of a sheet of air-filled protective material according to one embodiment of the present invention.

FIG. 4 illustrates a sheet of air-filled protective material 14 generated by the supply machine 220 according to one embodiment. As shown in FIG. 4, the air-filled protective cushioning 14 comprises a plurality of small, air-filled air pockets 501 connected by small air channels 502. The air pockets 501 and channels 502 are aligned in rows across the width of the sheet of protective cushioning 14. In addition, the adjacent rows of air pockets 501 are staggered such that each air pocket 501 is generally aligned with the space separating pairs of air pockets 501 in the adjacent rows. The air-filled protective material 14 is generally configured for being wrapped around a packaged item in order to absorb impacts that might otherwise be fully transmitted to the item during transit. Accordingly, in certain embodiments, perforations may be disposed across the width of the sheets of air-filled protective material 14 to enable workers to easily separate lengths of protective material 14 and wrap them around items awaiting packaging.

As shown in FIG. 2, the supply machines 210, 220 are configured for conveying the strings of air-filled dunnage cushions 12 and sheets of air-filled protective material 14 into the bin 100. However, when dispensed into an enclosed area, the strings of air-filled dunnage cushions 12 and sheets of air-filled protective material 14 exhibit different flow characteristics. For example, the film gaps 402 between the air-filled dunnage cushions 12 permit the strings of air-filled dunnage cushions 12 to remain flexible. In addition, in certain embodiments, the dunnage cushions 12 are manufactured from a relatively thin-gauge film material, thereby enhancing the overall flexibility of the strings. As a result, the strings of air-filled dunnage cushions 12 tend to flow relatively easily throughout an enclosed area, such as the bin 100.

In contrast, the air-filled portions of the protective cushioning 14 are comparatively stiff. As a result, the laterally-aligned air-filled pockets 501 and air-filled channels 502 impart a stiffness to the protective cushioning 14 that makes the sheets comparatively resistive to being twisted or folded about their longitudinal axis. In addition, the numerosity and proximity of the air pockets 501 to one another adds further to the comparative stiffness of the air-filled protective material 14. Furthermore, in certain embodiments, the air-filled protective cushioning 14 is manufactured from a thicker-gauge film material that is less pliable than the film material used in the dunnage cushions 12. As such, the sheets of air-filled protective material 14 is generally flow less easily through an enclosed area than the strings of air-filled dunnage material 12.

In order to accommodate the differing flow characteristics of the strings of dunnage cushions 12 and sheets of air-filled protective material 14, the system 10 of FIG. 2 is configured convey the air-filled protective material 14 into the inner compartment 110 and the dunnage cushions 12 into the outer compartment 120. In particular, the protective material supply machine 220 conveys the sheets of air-filled protective material 14 through ducting 222 and into the inner compartment 110 via one of the inner compartment receiving apertures 115. Likewise, the dunnage material supply machine 210 conveys the air-filled dunnage cushions 12 through ducting 212 and into the outer compartment 120 via the outer compartment receiving aperture 107. This configuration permits the less-fluid sheets of air-filled protective cushioning 14 to amass within the inner compartment 110, while the more-fluid strings of air-filled dunnage cushions 12 flow around the inner compartment 110 and into both sides of the outer compartment 120.

Figure 5:
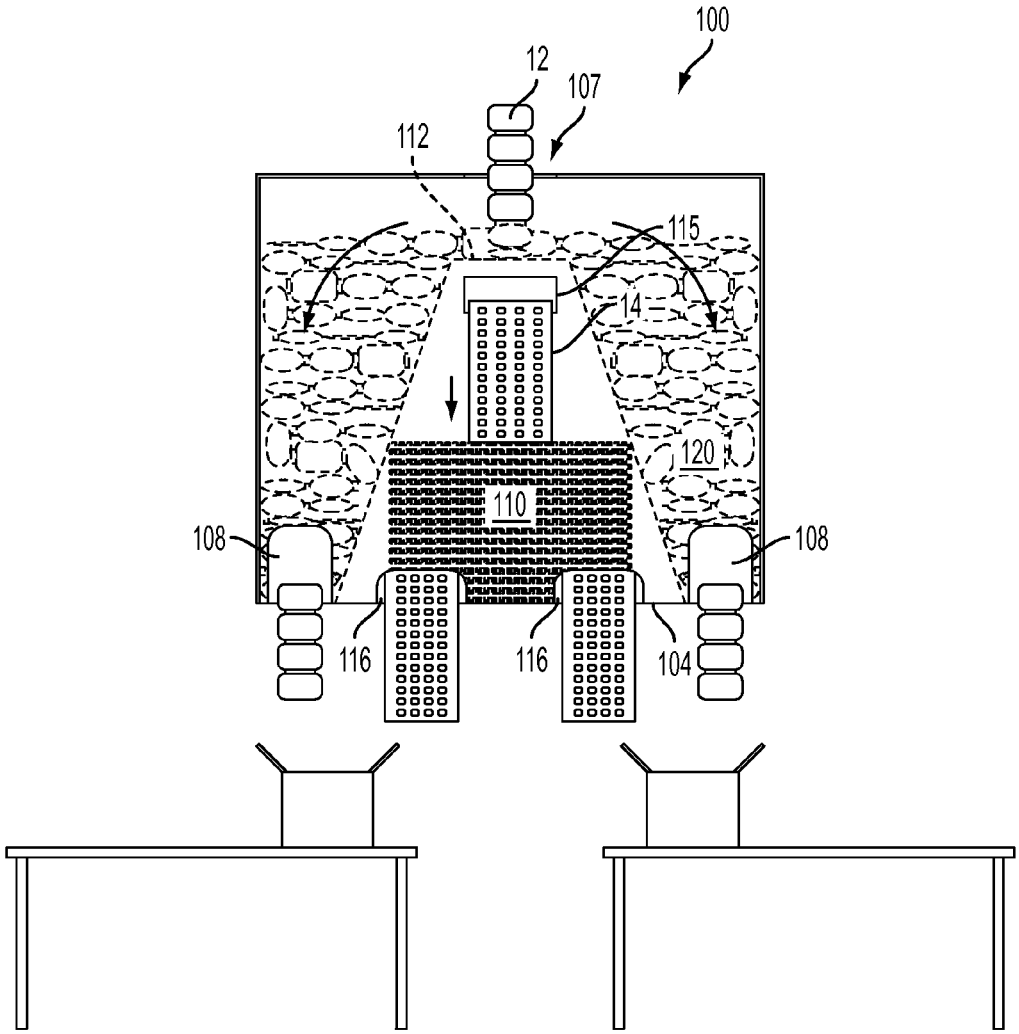
FIG. 5 shows a front plan view of a bin receiving and dispensing air-filled materials according to the embodiment of FIG. 1.

FIG. 5 illustrates a cut-away front view of the bin 100 as it is being filled with air-filled material 12, 14. As shown in FIG. 5, the strings of air-filled dunnage cushions 12 are conveyed through the outer compartment receiving aperture 107 and fall downward, where they are met by the inner compartment's upper wall 112 and directed to the lateral portions of the outer compartment 120. The strings of air-filled dunnage cushions 12 then fall alongside the inner compartment's sloped walls 111 and toward the outer compartment dispensing apertures 108. The above-described flow characteristics of the strings of air-filled dunnage cushions 12 permit them to flow easily throughout the outer compartment 120 and to each of the four outer compartment dispensing apertures 108.

While the air-filled dunnage cushions 12 fill the outer compartment 120, the sheets of air-filled protective cushioning 14 are conveyed through one of the inner compartment receiving apertures 115 and fall downward onto the bottom wall 104 of the bin 100. As shown in FIG. 3, the sheets of air-filled protective material 14 settle in folded layers proximate each of the inner compartment dispensing apertures 116. Accordingly, as the material supply machines 210, 220 convey the air-filled materials 12, 14 into the bin 100, the compartments 110, 120 are filled and both strings of air-filled dunnage cushions 12 and sheets of air-filled protective cushioning 14 are positioned proximate the pairs of apertures 108, 116 at each of the bin's four corners. As a result, the bin 100 is capable of receiving each type of air-filled material 12, 14 from a single input source (e.g., the one supply machine 210 and one supply machine 220) and distributing the material to four separate access points (e.g., the four corners of the bin 100 having dispensing apertures 108, 116).

Figure 6:
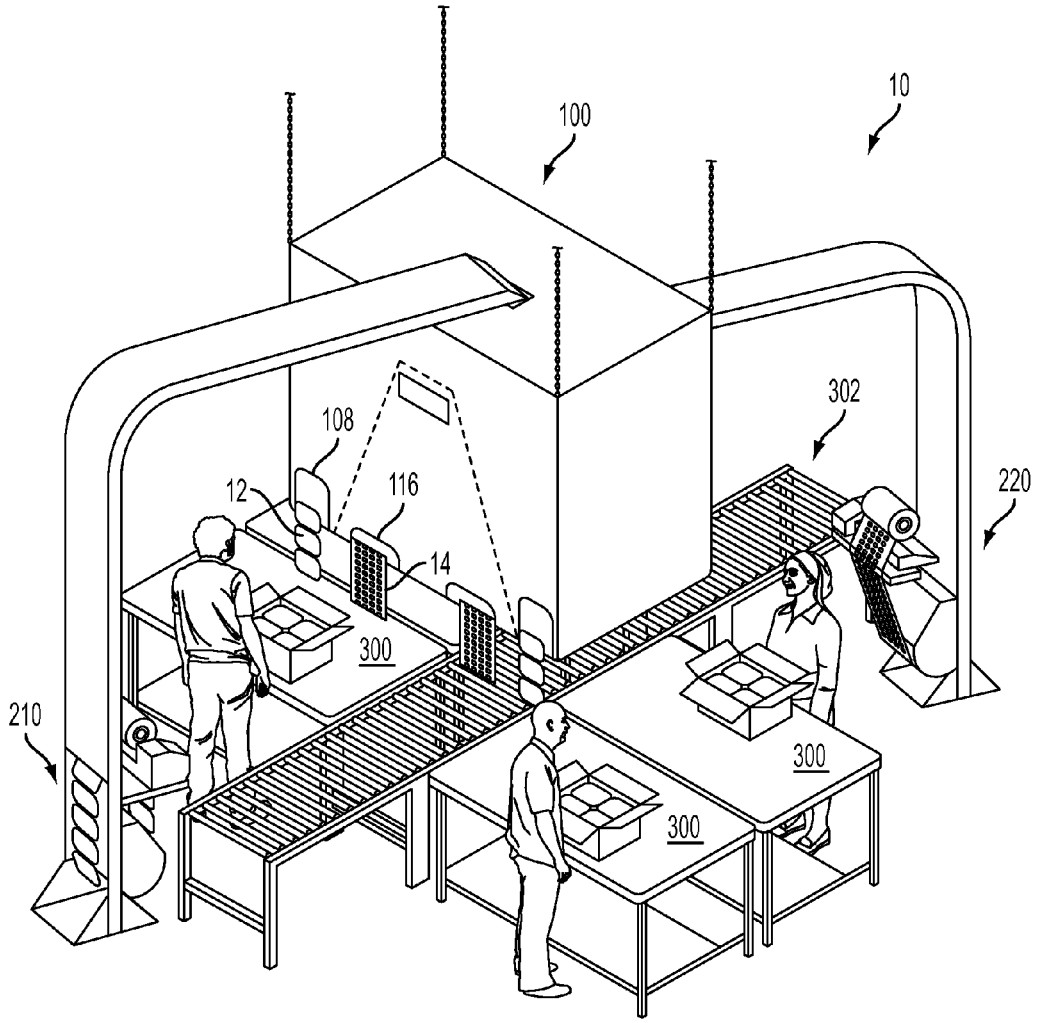
FIG. 6 shows a perspective view of a dispensing system in a packaging environment according to the embodiment of FIG. 2.

According to various embodiments, the system 10 may be adapted to distribute air-filled dunnage cushions 12 and air-filled protective material 14 to multiple workers in a packaging operation. For example, FIG. 6 shows a packaging environment according to one embodiment in which the system 10 is integrated for dispensing air-filled dunnage cushions 12 and air-filled protective material 14 to four packing stations 300. In the illustrated embodiment, the packing stations 300 are positioned around a central roller conveyor 302. The bin 100 is suspended such that it is centered above the roller conveyor 302 and its four corners are each proximate one of packing stations 300. As a result, a pair of outer compartment and inner compartment dispensing apertures 108, 116 is positioned proximate to each of the packing stations 300. As the material supply machines 210, 220 convey the air-filled materials 12, 14 to the bin 100, the compartments 110, 120 are filled and both the strings of air-filled dunnage cushions 12 and sheets of air-filled protective cushioning 14 are accessible to the workers at each of the packing stations 300 via the apertures 108, 116. As such, the bin 100 enables each supply machine 210, 220 to deliver its respective air-filled material 12, 14 to four separate packing stations 300 and, thereby, four individual workers.

Figure 7:
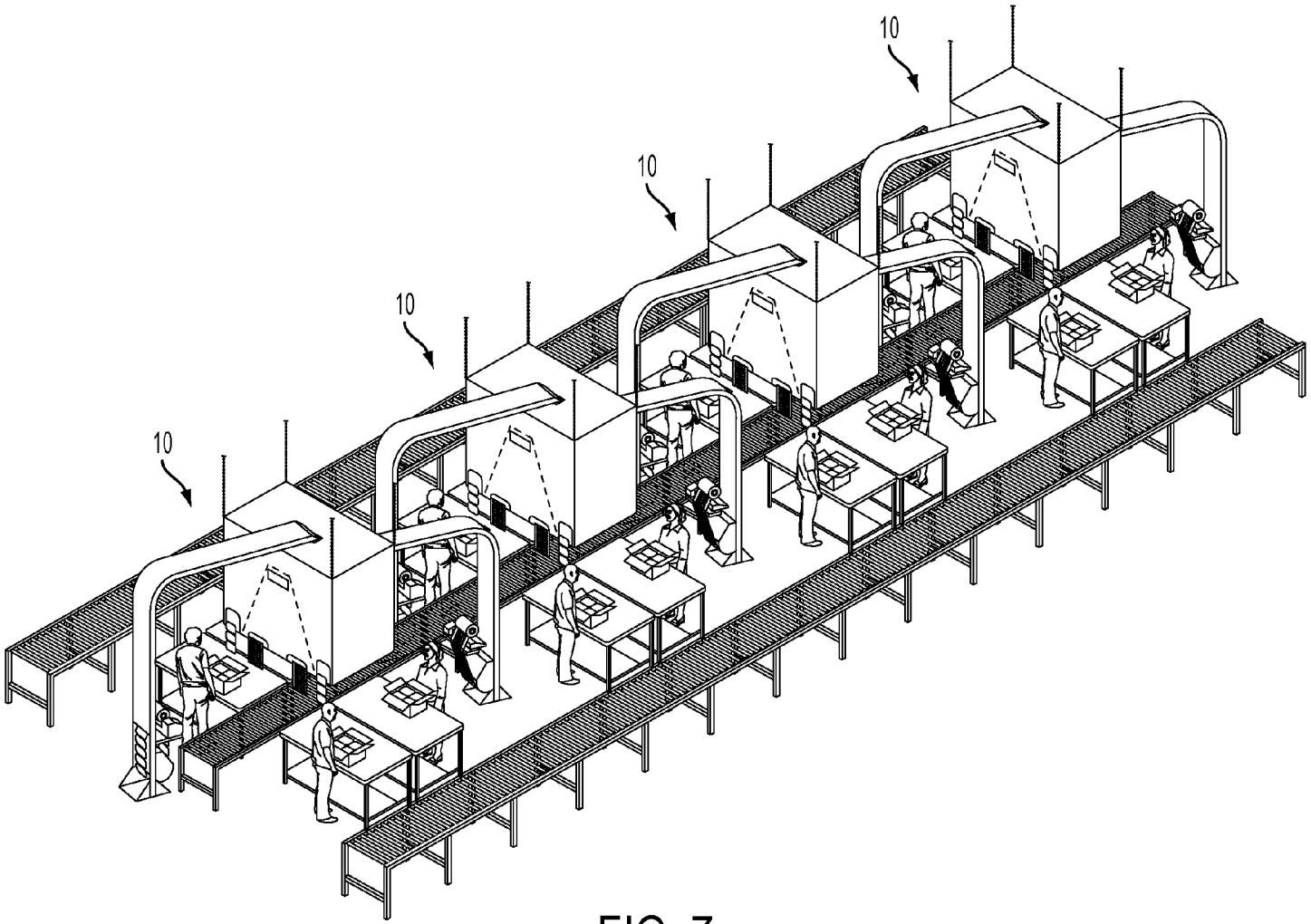
FIG. 7 shows a perspective view of multiple dispensing systems in a packaging environment according to one embodiment of the present invention.

In the illustrated embodiment of FIG. 6, no more than two supply machines 210, 220 and no more than a single overhead bin 100 are required to provide both types of air-filled material 12, 14 to each of the four packing stations 300. As a result, the system 10 conserves a significant amount of floor space in the environment of FIG. 6 and reduces the number of supply machines 210, 220 necessary to supply the air-filled material 12, 14 required by the packing operation. In further embodiments, multiple systems 10 may be provided in a packaging operation to provide dispense air-filled material to additional workers. For example, FIG. 7 illustrates a packing environment in which multiple dispensing systems 10 are provided at multiple packing station clusters arranged as part of an integrated packaging operation.

As will be appreciated from the description herein, the bin 100 and system 5 may be used as part of a method for dispensing different types of materials. For example, in one embodiment, a method for dispensing a first material and a second material is contemplated comprising the following steps. To begin, the first material is loaded into the inner compartment 110 via one of the inner compartment receiving apertures 115 (e.g., manually or by using the first material supply machine 210). Next, the second material is loaded into the outer compartment 120 (e.g., via the outer compartment receiving aperture 107 or an open upper region of the outer compartment 120, and accomplished manually or by using the second material supply machine 220). Next, the first material is removed from the inner compartment 110 of the bin 100 via access at one of the inner compartment dispensing apertures 116 and the second material is removed from the outer compartment 120 of the bin 100 via access at one of the outer compartment dispensing apertures 108.

Additional Embodiments of the Dispensing Bin

As will be appreciated from the description herein, various modifications may be made to the dispensing bin 100 described herein while remaining compatible with the dispensing systems described herein and remaining within the scope of the present inventions. For example, in certain embodiments, the bin 100 may not include a top wall 106, leaving the top of the bin 100 generally open. In such embodiments, the system 10 may be configured such that its dunnage material supply machine 210 conveys strings of air-filled dunnage cushions 12 into the bin's upper opening, as opposed to a particular receiving aperture. In addition, the bin 100 may include more, or less, receiving and dispensing apertures for each of the inner compartment 110 and outer compartment 120. As will be appreciated from the description herein, according to various embodiments, the number of and position of receiving and dispensing apertures may vary according to the requirements of the dispensing system and packing environment for which the bin 100 is configured. For example, in certain embodiments, more than four pairs of inner compartment and outer compartment dispensing apertures 108, 116 may defined on the bin 100 in order to provide more than four access points for the packing materials dispensed therefrom. In addition, the receiving and dispensing apertures 108, 116, 107, 115 may be defined at various locations on the bin 100. For example, in certain embodiments, the dispensing apertures 108, 116 may be defined proximate the center of the bin's sidewalls 102. In certain embodiments the dispensing apertures 108, 116 are defined on the bottom wall 104 of the bin 100. In other embodiments, the receiving apertures are positioned beneath the dispensing apertures (e.g., to enable the material supply machines 210, 220 to force material upwardly through the bin 100).

Furthermore, according to various embodiments, the inner compartment 110 and outer compartment 120 may be configured in a variety of shapes and sizes while remaining capable of directing packing materials disposed in the compartments 110, 120 to one or more dispensing apertures. For example, in certain embodiments the sloped walls 111 of the inner compartment 110 may be substantially vertical. In other embodiments, the inner compartment 110 may not include a top wall 112. In further embodiments, the inner compartment 110 or outer compartment 120 may have a non-rectangular cross-section, such as an elliptical cross-section. In addition, the inner compartment 110 and outer compartment 120 may be reconfigured as necessary to provide for additional receiving or dispensing apertures in various locations around the bin 100. For example, in one embodiment the inner compartment may include a portion extending to the lateral sides of the bin 100 in order to provide additional inner compartment dispensing apertures. In other embodiments, the bin 100 may include additional compartments, such as multiple inner and/or outer compartments configured to direct packing materials disposed therein to one or more dispensing apertures.

Figure 8:
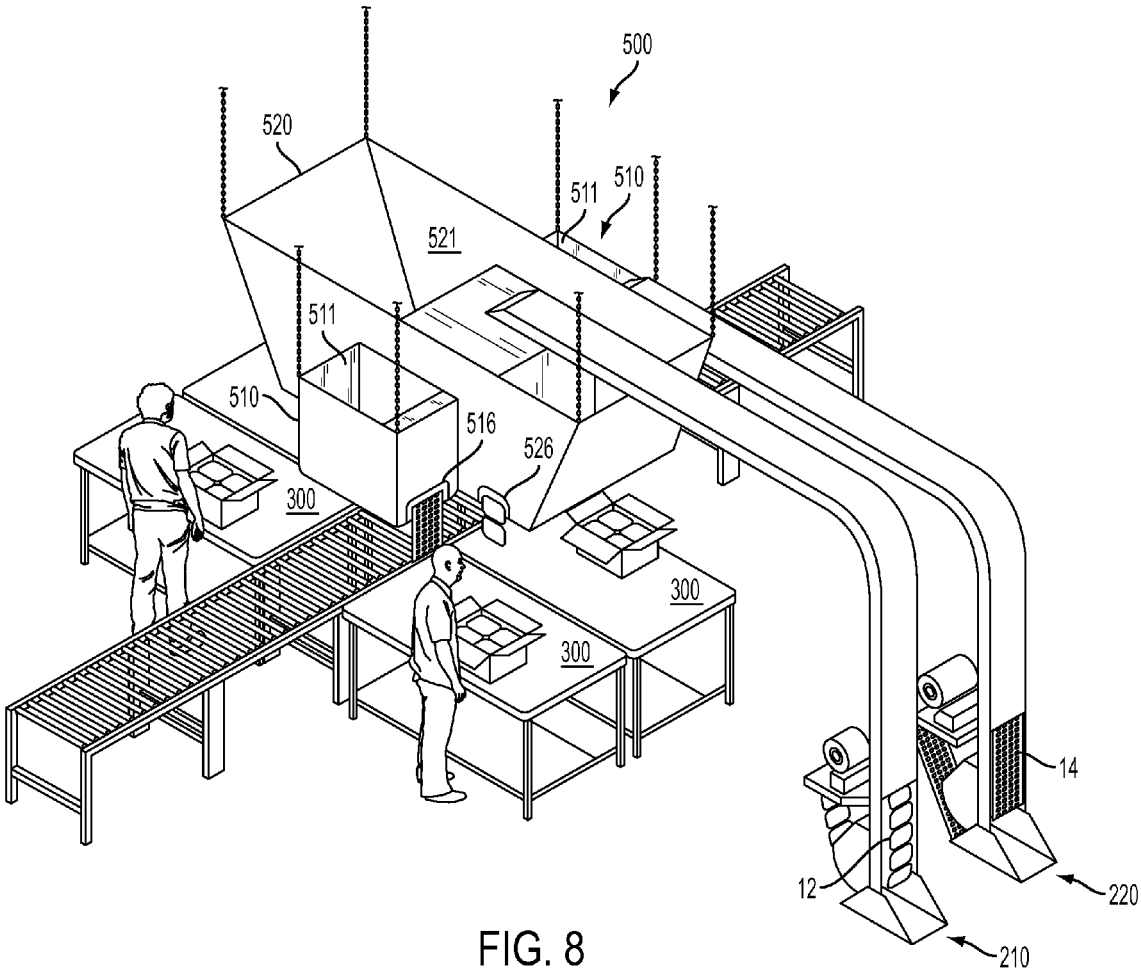
FIG. 8 shows a perspective view of a bin and dispensing system according to another embodiment of the present invention.

As yet another example of the configuration of the bin's inner and outer compartments, FIG. 8 shows a bin 500 according to another embodiment. The bin 500 includes an inner compartment 510 and an outer compartment 520 that are each generally elongated and oriented such that they are substantially perpendicular to one another. In the illustrated embodiment, the inner compartment 510 defines a pair of upper openings 511 and a plurality of dispensing apertures 516. Likewise, the outer compartment 520 defines an upper opening 521 and a plurality of dispensing apertures 526. The dispensing apertures are positioned such that pairs of inner compartment and outer compartment dispensing apertures 516, 526 are positioned together at corners of the bin 500.

As shown in FIG. 8, the inner compartment 510 and outer compartment 520 are oriented perpendicular to one another such that a first portion of the outer compartment 520 extends above a medial portion of the inner compartment 510 and a second portion of the outer compartment 520 surrounds the lateral sides of the medial portion of the inner compartment 510. In the illustrated embodiment, the medial portion of the inner compartment 510 includes an upper wall which ensures the inner compartment 510 is not open to the outer compartment 520. This configuration permits a protective material supply machine 220 to convey sheets of protective material 14 to the inner compartment 510 via either of its upper openings 511, while a dunnage material supply machine 210 conveys strings of dunnage cushions 12 to the outer compartment 520 via its upper opening 521.

Similarly to the bin 100 of FIG. 3, the sheets of protective material 14 settle in layers in the inner compartment 510 and are accessible via the plurality of dispensing apertures 516. Meanwhile, the dunnage cushions 12 fall within the outer compartment 520 and are then directed around the medial portion of the inner compartment 510 and into lateral portions of the outer compartment 520. As such, both the dunnage cushions 12 and air-filled protective material 14 are accessible via the dispensing apertures 516, 526 at each corner of the bin 500.

In the illustrated embodiment of FIG. 8, the bin 500 is positioned above four packing stations 300. As shown in FIG. 8, the bin 500 permits the two supply machines 210, 220 to provide both types of material 12, 14 to each of the four packing stations 300. Like the system 10 of FIG. 6, the system of FIG. 8 conserves a significant amount of floor space and reduces the number of supply machines 210, 220 necessary to supply the material 12, 14 required by the packing operation.

Additional Embodiments of the Dispensing System

As will be appreciated from the description herein, various modifications may also made to the system 10 described herein while remaining compatible with the various dispensing bins described herein and remaining within the scope of the present inventions. For example, in certain embodiments the supply machines 210, 220 may be configured to convey their respective materials via conveyors. In further embodiments, one or more sensors (e.g., an optical sensor) may be provided on the bin 100 to automatically detect when inner and outer compartments 110, 120 are sufficiently filled with material or need to be supplied with additional material from the supply machines 210, 220. In such embodiments, the supply machines 210, 220 may be configured to automatically refill the bin 100 based on feedback from the sensors.

In the illustrated embodiment of FIG. 7, a pair of supply machines 210, 220 are provided at each packing station cluster. However, in other embodiments, a single supply machine 210, 220 could be configured to covey its respective material 12, 14 to a plurality of packing stations. For example, in one embodiment, the dunnage material supply machine 210 may be provided with ducting that extends above a plurality of bins 100 and is configured to selectively direct dunnage cushions 12 to each of the plurality of bins (e.g., using a variety of outlets along the ducting). Likewise, in one embodiment, the protective material supply machine 220 may be provided with ducting that extends through a plurality of bins 100 and is configured to selectively direct sheets of protective material 14 to each of the plurality of bins.

Furthermore, the system 10 may be configured to convey different types of materials other than those specifically described herein. For example, the system 10 could include supply machines configured to convey different sized strings of dunnage cushions 12, one size being disposed in one bin compartment and another size being disposed in another bin compartment. Indeed, various other types of air-filled packing materials having properties analogous to those described herein could be generated and conveyed by supply machines and dispensed by the various bin embodiments described herein. Likewise, the systems and dispensing bins described herein may be adapted to convey and dispense non-air-filled materials, such as paper dunnage or foam cushioning materials (e.g., polyethylene foam materials).

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A bin for dispensing first and second materials, the bin comprising:

an inner compartment defining one or more inner compartment receiving apertures providing access for loading the first material into the inner compartment and defining one or more inner compartment dispensing apertures providing access for dispensing the first material from the inner compartment; and an outer compartment providing access for loading the second material into the outer compartment and defining one or more outer compartment dispensing apertures providing access for dispensing the second material from the outer compartment, wherein at least an elevated portion of the outer compartment is positioned above the inner compartment and at least a surrounding portion of the outer compartment surrounds a lateral portion of the inner compartment;

wherein the bin is configured to receive and dispense the first and second materials without commingling the first and second materials.

2. The bin of claim 1, wherein at least one of the outer compartment dispensing apertures is positioned proximate at least one of the one or more inner compartment dispensing apertures.

3. The bin of claim 2, wherein the at least one outer compartment dispensing aperture positioned proximate at least one inner compartment dispensing aperture is positioned within six feet of the nearest inner compartment dispensing aperture.

4. The bin of claim 1, wherein the inner compartment and outer compartment are configured such that first materials loaded into the inner compartment are directed to the inner compartment dispensing apertures and such that second materials disposed within the outer compartment are directed over and around at least a portion of the inner compartment to the outer compartment dispensing apertures.

5. The bin of claim 1, wherein the inner compartment and outer compartment define at least four pairs of dispensing apertures, each dispensing aperture pair comprising one of the inner compartment dispensing apertures and one of the outer compartment dispensing apertures positioned proximate one another, and wherein each pair of dispensing apertures is substantially spaced apart from the other pairs of dispensing apertures.

6. The bin of claim 1, wherein the inner compartment and outer compartment are each generally elongated and oriented such that they are substantially perpendicular to one another.

7. The bin of claim 1, further comprising:

one or more outer walls defining an at least partially enclosed area, wherein the one or more inner compartment receiving apertures, one or more inner compartment dispensing apertures, and one or more outer compartment dispensing apertures are defined in at least one of the outer walls; and one or more inner walls, wherein at least a portion of the volume within the inner walls comprises the inner compartment and at least a portion of the volume between the inner walls and outer walls comprises the outer compartment.

8. The bin of claim 7, wherein the outer walls comprise one or more side walls and at least one bottom wall, the one or more side walls extending upwardly from the at least one bottom wall; and wherein the inner walls comprise one or more sloped walls having lower ends positioned adjacent the bottom wall, wherein at least one inner compartment receiving aperture is defined on at least one of the side walls and is positioned proximate the upper ends of the sloped walls and wherein at least one outer compartment dispensing aperture is positioned proximate the lower ends of the one or more sloped walls.

9. The bin of claim 8, wherein the one or more sloped walls each form an angle with an inner compartment portion of the bottom wall that is between 30 and 60 degrees.

10. The bin of claim 8, wherein the side walls are configured such that the bin has a rectangular cross-section having four corners; and wherein at least one outer compartment dispensing aperture and at least one inner compartment dispensing aperture are positioned proximate each of the bin's four corners.

11. The bin of claim 8, wherein the outer walls further comprise a top wall defining at least one outer compartment receiving aperture.

12. A method of dispensing first and second materials, the method comprising the steps of:

loading the first material into the inner compartment of the bin of claim 1;

loading the second material into the outer compartment of the bin of claim 1;

accessing the first material via one or more of the inner compartment dispensing apertures of the bin of claim 1 and removing the first material from the inner compartment of the bin of claim 1; and accessing the second material via one or more of the outer compartment dispensing apertures of the bin of claim 1 and removing the second material from the inner compartment of the bin of claim 1.

13. The method of claim 12, wherein the step of loading the first material is accomplished by loading the first material through the bin's inner compartment receiving aperture; and wherein the step of loading the second material is accomplished by loading the second material through an outer compartment receiving aperture provided on the bin of claim 1.

14. The method of claim 12, wherein the first material and second material are air-filled materials.

15. The method of claim 14, wherein the first material and second material are different types of materials.

16. The method of claim 15, wherein the first material comprises a sheet of air-filled protective cushioning and the second material comprises a string of air-filled dunnage cushions.

17. The method of claim 15, wherein the second material flows more easily through an enclosed area than the first material.

* * * * *